US012011675B1

(12) United States Patent
Schuyler et al.

(10) Patent No.: US 12,011,675 B1
(45) Date of Patent: Jun. 18, 2024

(54) ROTATIONALLY TRANSFORMABLE TOY BETWEEN A FIRST CONFIGURATION AND A SECOND CONFIGURATION

(71) Applicants: DISCONIFTY LTD., Toronto (CA); Alistair Parker-Rees-Fernandez, Falmouth (GB)

(72) Inventors: Rob Schuyler, Toronto (CA); Kristin Aydin, Toronto (CA); Keith Newstead, Falmouth (GB)

( * ) Notice: Subject to any disclaimer, the term of this patent is extended or adjusted under 35 U.S.C. 154(b) by 0 days.

(21) Appl. No.: 18/194,169

(22) Filed: Mar. 31, 2023

(51) Int. Cl.
*A63H 33/00* (2006.01)
*A63H 3/36* (2006.01)

(52) U.S. Cl.
CPC ..... *A63H 33/003* (2013.01); *A63H 3/36* (2013.01)

(58) Field of Classification Search
CPC ..... A63H 33/003; A63H 3/36; A63H 13/16
USPC ..... 446/268, 320, 376
See application file for complete search history.

(56) References Cited

U.S. PATENT DOCUMENTS 152,250 A * 6/1874 Powers ..... A63H 13/16 446/361
1,148,540 A 8/1915 Sancier
2,195,127 A 3/1940 Eli
2,325,750 A * 8/1943 De Vries ..... A63H 3/12 446/321
2,623,329 A * 12/1952 Di Leva ..... A63H 3/48 446/320
2,627,700 A * 2/1953 Weiss ..... A63H 11/06 446/312
2,767,516 A * 10/1956 Del Mas ..... A63H 3/48 446/376
2,968,121 A * 1/1961 Pearson, Jr. ..... A63H 37/00 403/166
3,293,783 A * 12/1966 Rosenfeld ..... G09F 19/12 446/353
3,828,467 A * 8/1974 Kaelin ..... A63H 3/52 446/361
3,851,419 A * 12/1974 Kaelin ..... A63H 3/12 446/321
3,896,584 A * 7/1975 Terzian ..... A63H 3/28 446/192
4,237,649 A * 12/1980 Goldfarb ..... G09B 23/281 446/330
4,413,442 A 11/1983 McSweeney
4,568,304 A 2/1986 Santa
4,622,021 A * 11/1986 Darrigo, Sr. ..... A63H 3/48 446/320

(Continued)

FOREIGN PATENT DOCUMENTS

JP 2012187353 A 10/2012
WO 2013049678 A1 4/2013

*Primary Examiner* — Joseph B Baldori
(74) *Attorney, Agent, or Firm* — Bhole IP Law; Anil Bhole; Marc Lampert

(57) ABSTRACT

There is provided a toy transformable between a first configuration and a second configuration. The toy including: an open or openable primary portion defining a hollow cavity; a secondary portion pivotably connected to the primary portion to have the secondary portion reside at least partially inside the hollow cavity in the first configuration upon rotation of the primary portion in a first direction, and have the secondary portion primarily reside outside of the hollow cavity in the second configuration upon rotation of the primary portion in a second direction.

12 Claims, 15 Drawing Sheets

(56) References Cited

U.S. PATENT DOCUMENTS 4,698,043 A * 10/1987 May ..... A63H 33/005 446/273
5,087,219 A * 2/1992 Price ..... A63H 3/20 446/354
5,149,289 A 9/1992 Edwards et al.
5,162,013 A * 11/1992 von Mohr ..... A63H 3/12 446/183
6,126,507 A 10/2000 Lieberman
6,679,749 B2 * 1/2004 Yu ..... A63H 3/36 446/314
6,800,014 B2 * 10/2004 Dominici ..... A63H 3/48 446/338
7,306,504 B2 * 12/2007 Saucier ..... A63H 33/003 446/268
7,785,168 B2 * 8/2010 Yamada ..... A63H 33/003 446/99
8,517,791 B2 * 8/2013 Yamada ..... A63H 33/26 446/129
8,684,782 B2 4/2014 Fiore
8,974,264 B2 * 3/2015 McCafferty ..... A63H 13/16 446/430
9,370,725 B2 * 6/2016 Choi ..... A63F 1/04
9,550,128 B1 1/2017 Pruzansky et al.
9,616,353 B2 4/2017 Chan et al.
9,808,731 B1 * 11/2017 Liu ..... A63H 33/003
9,925,474 B1 3/2018 Sutton
10,307,684 B2 * 6/2019 Choi ..... A63H 17/02
10,413,103 B1 * 9/2019 Balanchi ..... A63H 33/003
10,421,028 B2 * 9/2019 Choi ..... A63H 17/02
10,695,687 B2 * 6/2020 Fernandez ..... A63H 33/003
10,786,745 B2 9/2020 Chan et al.
10,864,452 B2 * 12/2020 Fernandez ..... A63H 13/00
11,123,653 B2 * 9/2021 Choi ..... A63H 33/26
11,173,411 B2 11/2021 Badie et al.
11,235,253 B2 * 2/2022 Towne ..... A63H 3/36
11,291,924 B2 * 4/2022 Wang ..... A63H 3/04
11,376,515 B1 * 7/2022 Livingston ..... A63H 33/26
2007/0259592 A1 11/2007 Imai et al.
2010/0291831 A1 * 11/2010 Yamada ..... A63H 33/003 446/129
2012/0108137 A1 5/2012 Sutton
2015/0306516 A1 10/2015 Stocker-Edwards
2016/0361661 A1 * 12/2016 Tiefel ..... A63H 33/003
2018/0264369 A1 * 9/2018 Sutton ..... A63H 3/12
2020/0238183 A1 * 7/2020 Towne ..... A63H 3/36
2020/0238185 A1 * 7/2020 Towne ..... A63H 3/36
2022/0258064 A1 * 8/2022 Schuyler ..... A63H 3/28
2022/0339551 A1 * 10/2022 Ainley ..... A63H 33/042

* cited by examiner

ROTATIONALLY TRANSFORMABLE TOY BETWEEN A FIRST CONFIGURATION AND A SECOND CONFIGURATION

TECHNICAL FIELD

The following generally relates to toys, and more particularly, to a toy selectively transformable between a first configuration and a second configuration via rotation.

BACKGROUND

Toys, such as dolls, can have a variety of shapes and sizes and can represent endless characters, both real and imaginary. Like many other toys, dolls allow children to interact and play with movie or story book characters, making children realize their fantasies. Children are especially engaged with dolls that embody these characters in fantastical ways, such as by way of transformation.

SUMMARY

In an aspect, there is provided a toy transformable between a first configuration and a second configuration, the toy comprising: an open or openable primary portion defining a hollow cavity; a secondary portion pivotably connected to the primary portion to have the secondary portion reside at least partially inside the hollow cavity in the first configuration upon rotation of the primary portion in a first direction, and have the secondary portion primarily reside outside of the hollow cavity in the second configuration upon rotation of the primary portion in a second direction.

In a particular case, the primary portion comprises a front section and a rear section, the front and the rear section pivotably connected to abut and define the hollow cavity.

In another case, the front section is configured to pivot outwardly when the toy is rotated in the first direction, and the rear section is configured to pivot outwardly when the toy is rotated in the second direction.

In yet another case, the front section and the rear section are configured to align and form a central axis of the primary portion.

In yet another case, the secondary portion comprises a base and sides collectively defining a hollow interior, the base defining channels for one or more retractable elements to pass therethrough, the one or more retractable elements substantially extend into the hollow cavity in the first configuration and extend substantially outside of the hollow cavity in the second configuration.

In yet another case, a pivotable latch is disposed inside the hollow cavity to engage the one or more retractable elements and restrict upward movement of the one or more retractable elements into the hollow interior in the second configuration, and rotate to disengage from the one or more retractable elements in the first configuration.

In yet another case, the one or more retractable elements comprise legs.

In yet another case, the toy further comprising a tertiary portion pivotably connected to the secondary portion, the tertiary portion is dimensioned to reside inside the hollow cavity with the secondary portion in the first configuration, the tertiary portion pivots away from the primary portion in the second configuration upon rotation in the second direction.

In yet another case, the tertiary portion is a mermaid tail or wings.

In yet another case, the secondary portion comprises a horse body and the tertiary portion comprises a secondary set of legs.

In yet another case, the primary portion comprises a front section that curves towards a rear to define the hollow cavity.

In yet another case, the toy further comprising a tertiary portion to located on a side of the secondary portion, the tertiary portion forming wings in the first configuration and forming a mermaid tail in the second configuration.

BRIEF DESCRIPTION OF THE DRAWINGS

The present invention is described by way of embodiments illustrated in the accompanying drawings, wherein:

FIGS. 6A to 6K show side cross-sectional views of the toy of FIG. 1A illustrating rotation in a first direction from the first configuration to the second configuration;

FIGS. 7A to 7K show side cross-sectional views of the toy of FIG. 1A illustrating rotation in a second direction from the second configuration to the first configuration;

FIGS. 10A to 10J show side cross-sectional views of the toy of FIG. 9A illustrating rotation in a first direction from the first configuration to the second configuration; and FIGS. 11A to 11J show side cross-sectional views of the toy of FIG. 9A illustrating rotation in a second direction from the second configuration to the first configuration.

DETAILED DESCRIPTION

Figures 1A, 1B:
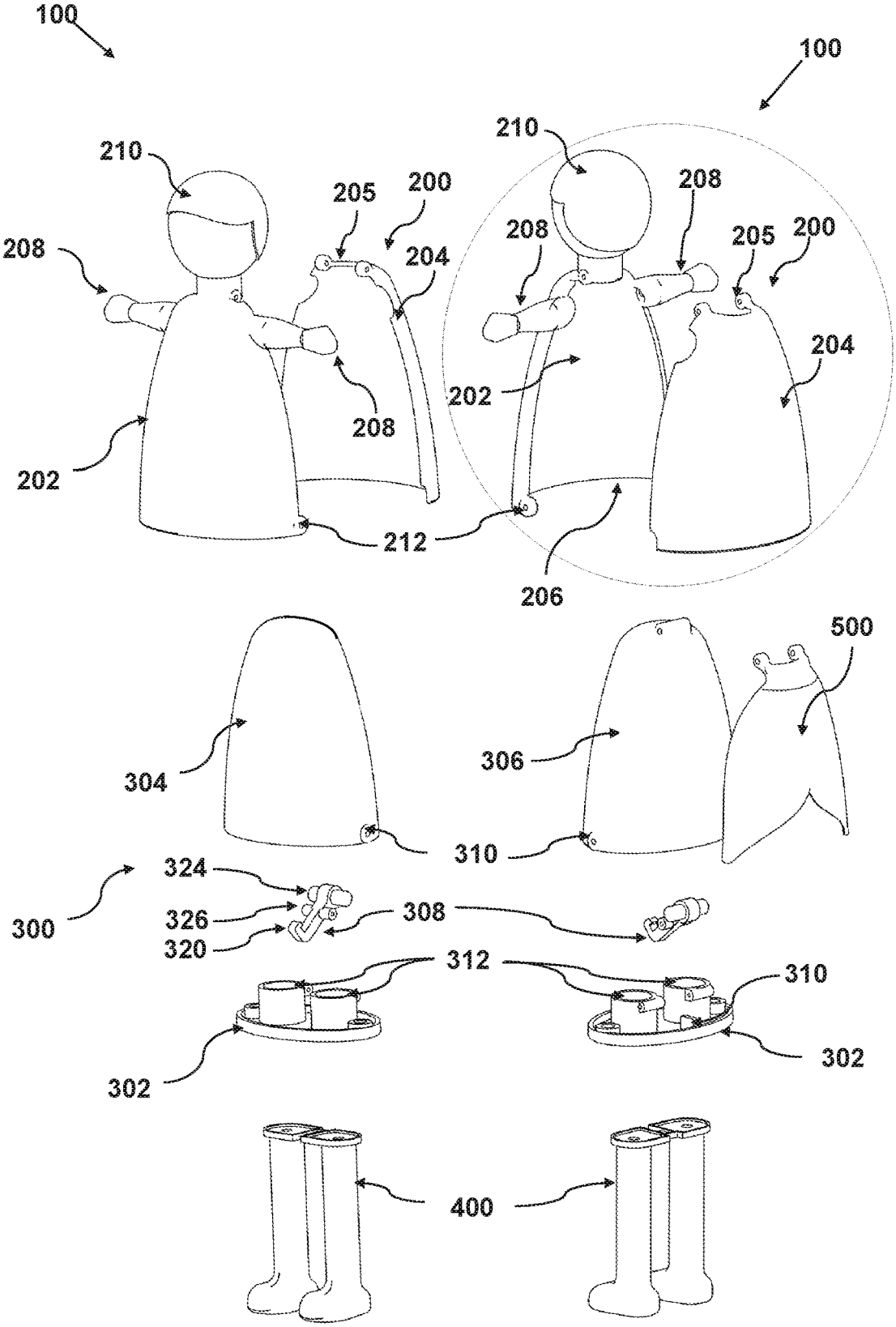
FIG. 1A is an exploded front view of a toy, in accordance with an embodiment.
FIG. 1B is an exploded rear view of the toy of FIG. 1A.

The disclosure is provided in order to enable a person having ordinary skill in the art to practice the invention. Exemplary embodiments herein are provided only for illustrative purposes and various modifications will be readily apparent to persons skilled in the art. The general principles defined herein may be applied to other embodiments and applications without departing from the scope described herein. The terminology and phraseology used herein is for the purpose of describing exemplary embodiments and should not be considered limiting. Thus, the present disclosure is to be accorded the widest scope encompassing numerous alternatives, modifications and equivalents consistent with the principles and features disclosed herein. For purposes of clarity, details relating to technical material that is known in the technical fields related to what is described herein have been briefly described or omitted so as not to unnecessarily obscure the present disclosure.

Various terms used throughout the present description may be read and understood as follows, unless the context indicates otherwise: singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. It is to be noted that, as used in the present description, by the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide. Further definitions for terms may be set out herein; these may apply to prior and subsequent instances of those terms, as will be understood from a reading of the present description.

For simplicity and clarity of illustration, where considered appropriate, reference numerals may be repeated among the Figures to indicate corresponding or analogous elements. In addition, numerous specific details are set forth in order to provide a thorough understanding of the embodiments described herein.

Generally, transformation of toys, such as dolls, from one form to another requires removing and replacing, or actively moving, one or more parts of the toy. For example, a toy may be transformed into a mermaid by replacing the legs of the toy with a mermaid tail attachment. In another example, a toy may be transformed into an angel with wings by connecting wings to the back of the doll. The aforementioned transformations between different configurations involve cumbersome replacements, connections, or a series of movements that can be difficult for young users. In other cases, the toy may require manual force or action such as snaps, clipping, or buckling for transformation between configurations. Such manual steps can spoil the fantasy for the child or cause the child to lose interest. Further, there is danger that a child might swallow one or more loose parts.

Advantageously, the toy of the present invention provides a substantially easy mechanism of transformation, such that even very young children could operate the transformation. The toy of the present invention is selectively transformable between a first configuration and a second configuration, by mere rotation of the toy in one of two directions; where 'between' is understood to mean that the toy can transition from the first configuration to the second configuration and/or from the second configuration to the first configuration.

In an embodiment, a toy is provided that comprises an openable, or open, primary portion, defining a hollow cavity therein. The toy also comprises a secondary portion pivotably connected to the primary portion.

In some cases, the primary portion can include a front section and a rear section that can be pivotably connected to abut and define the hollow cavity therewithin. In other cases, the primary portion can include a front section that curves towards a rear of the toy to define the hollow cavity therein.

The secondary portion can be configured to reside at least partially inside the hollow cavity in the first configuration upon rotation of the toy in a first direction, and the secondary portion can primarily reside outside of the hollow cavity (i.e., a greater proportion of the second portion being outside the cavity) upon rotation of the toy in a second direction. In some cases, the secondary portion can be associated with legs in the first configuration and associated with a mermaid's tail in the second configuration to enable a transformation between these configurations.

Advantageously, the child only needs to rotate the toy in one of two directions and the structure and arrangement of the present embodiments, making use of the force of gravity, enables the toy to transform. This supreme ease of use provides a substantial advantage over other approaches for transformable toys.

Figure 2:
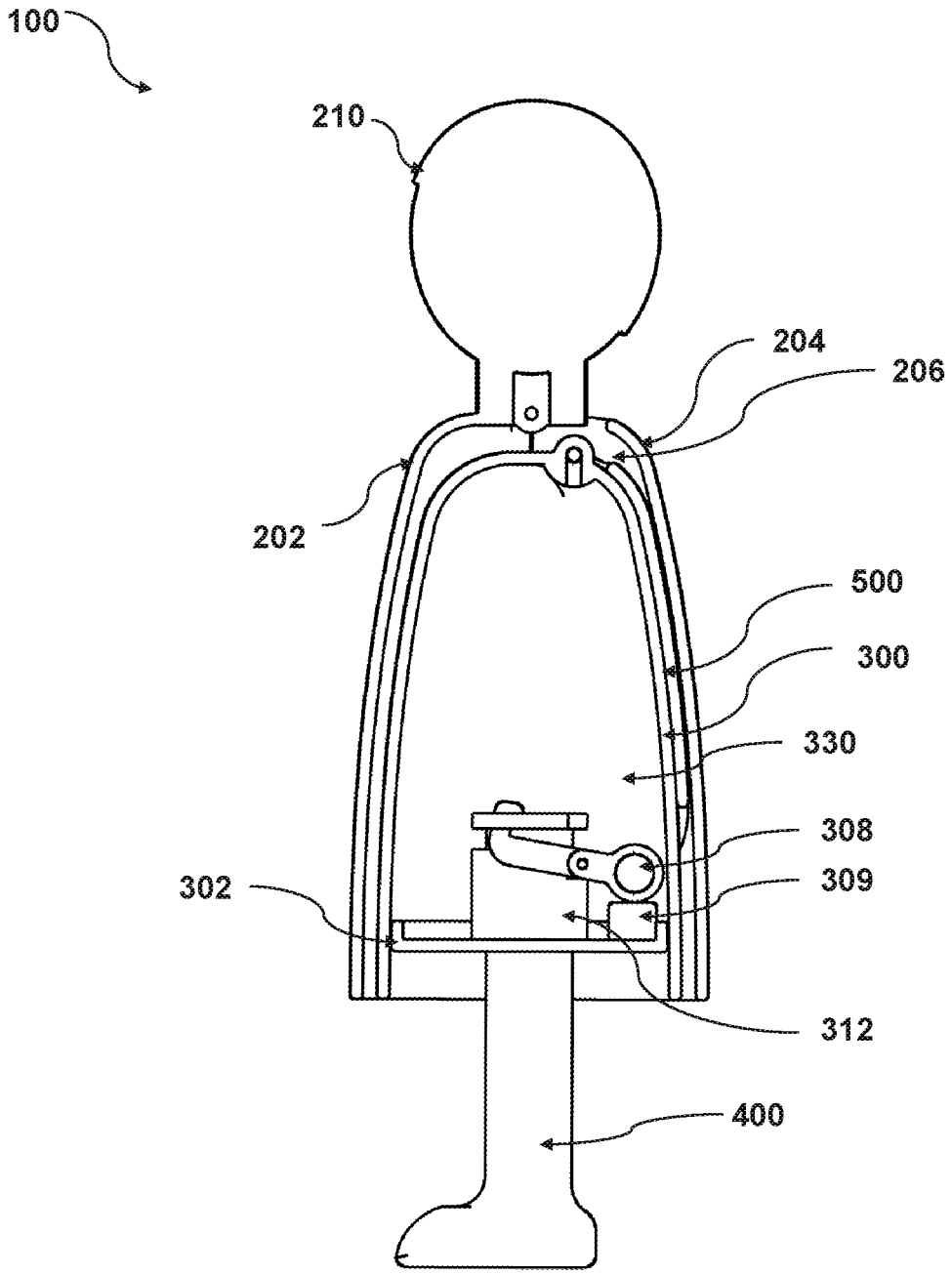
FIG. 2 is a side cross-sectional view of the toy of FIG. 1A in a first configuration.
Figure 3:
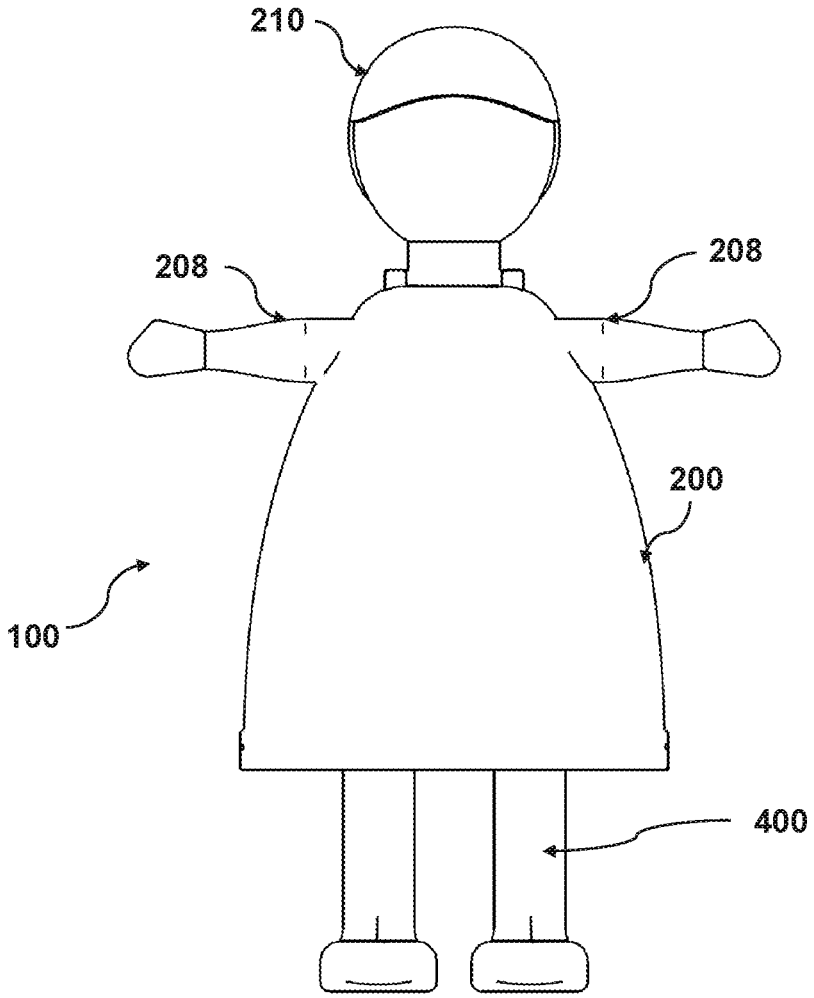
FIG. 3 is a front view of the toy of FIG. 1A in the first configuration.
Figure 4A:
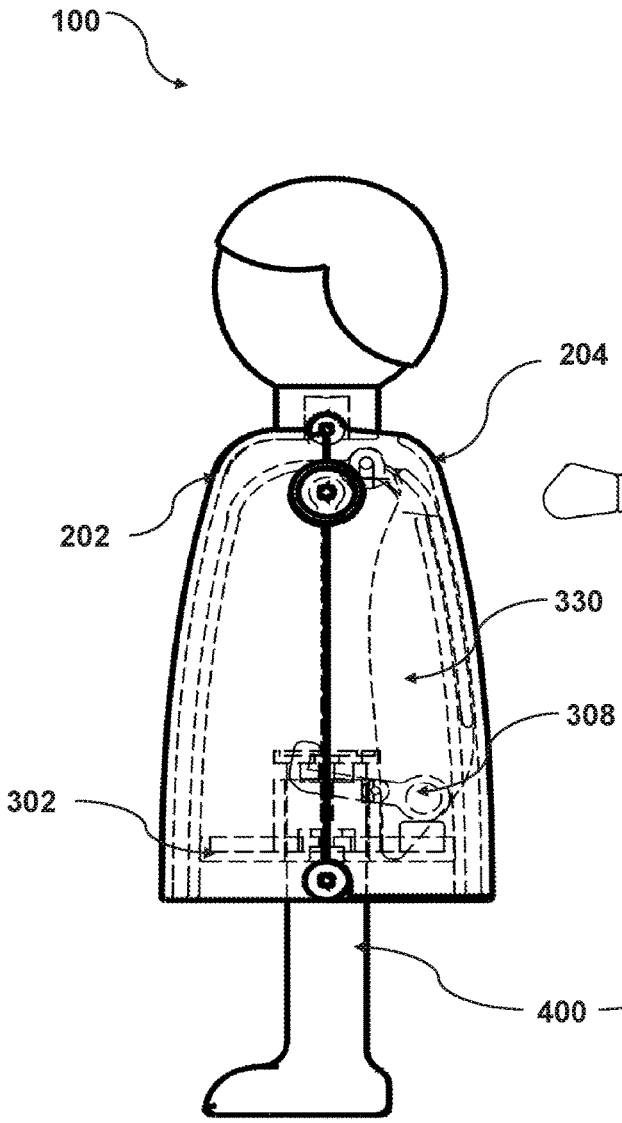
FIG. 4A is a side cross-sectional view of the toy of FIG. 1A in the first configuration.
Figure 4B:
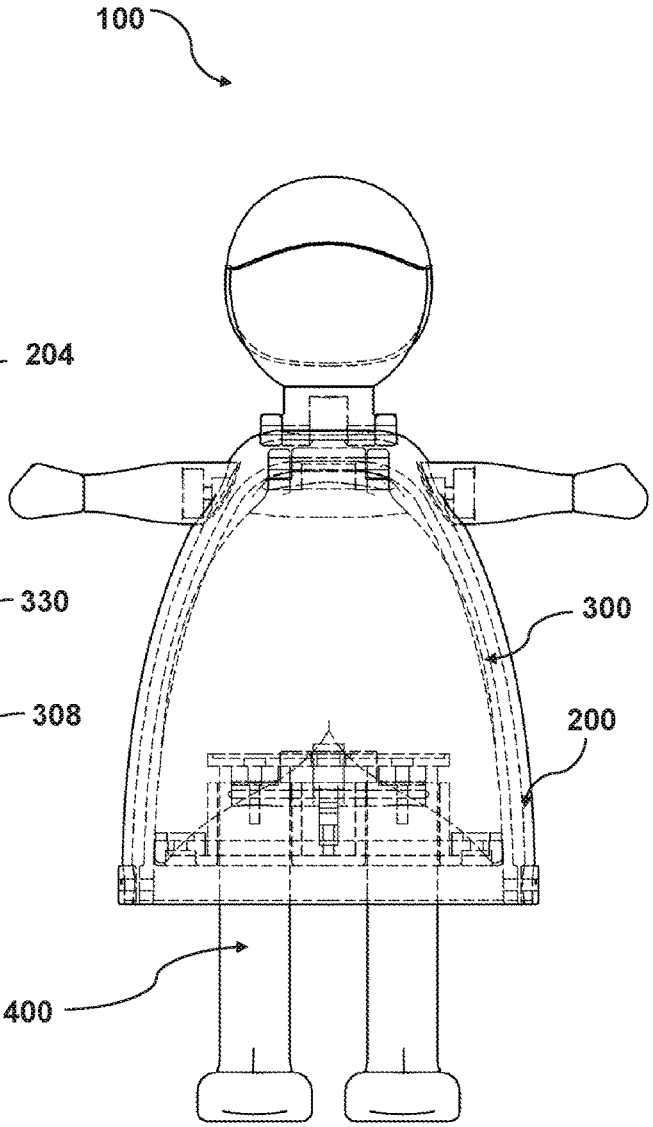
FIG. 4B is a front cross-sectional view of the toy of FIG. 1A in the first configuration.
Figure 5A:
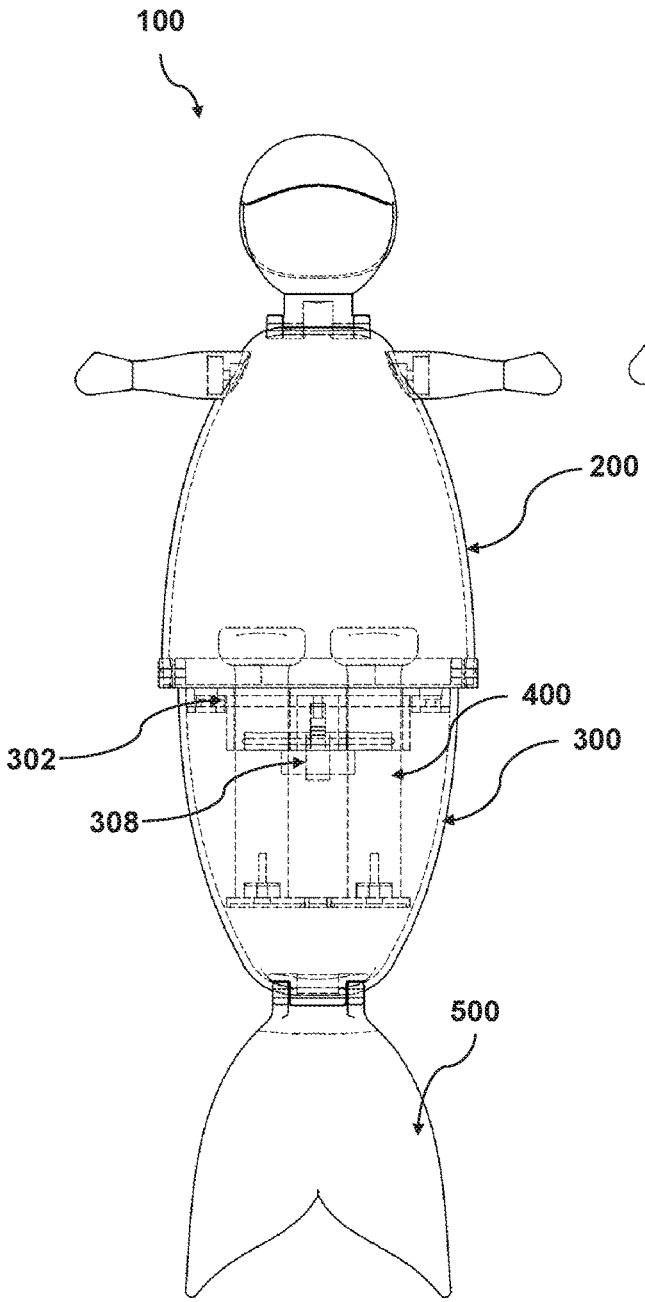
FIG. 5A is a front cross-sectional view of the toy of FIG. 1A in a second configuration.
Figure 5B:
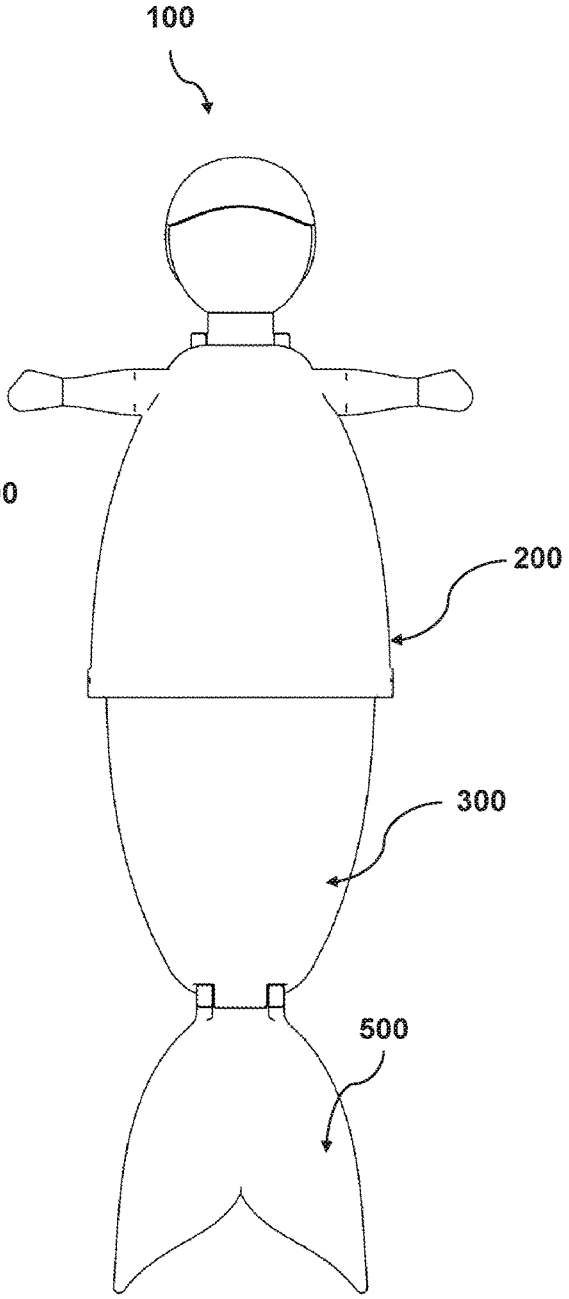
FIG. 5B is a front view of the toy of FIG. 1A in the second configuration.
Figure 6A:
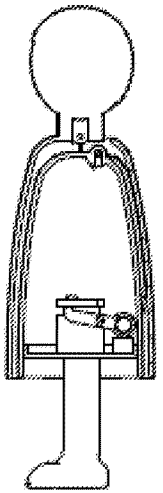
Figure 6B:
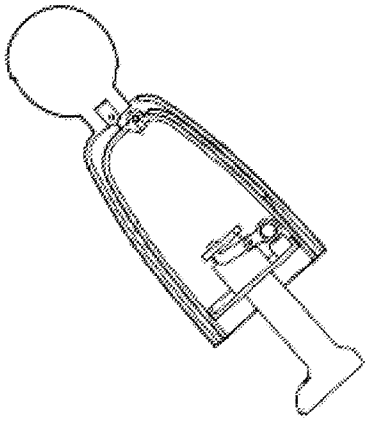
Figure 6C:
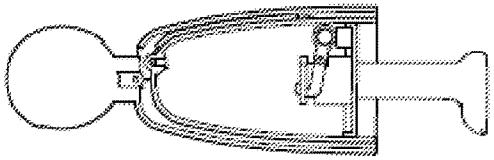
Figure 6D:
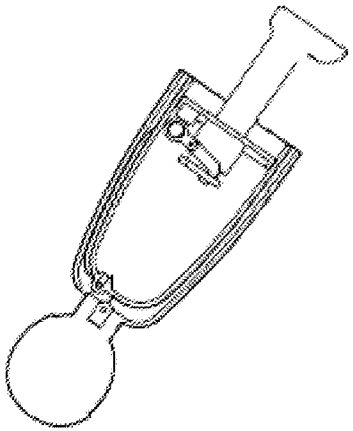
Figure 6E:
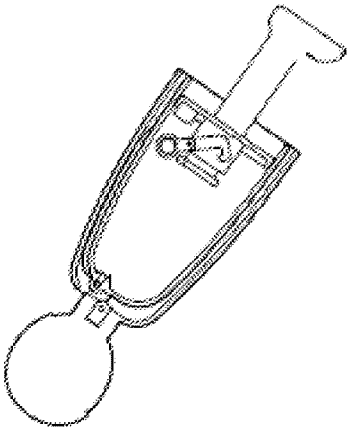
Figure 6F:
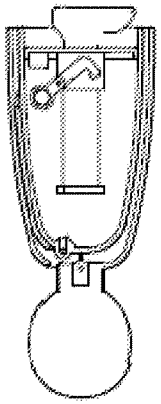
Figure 6K:
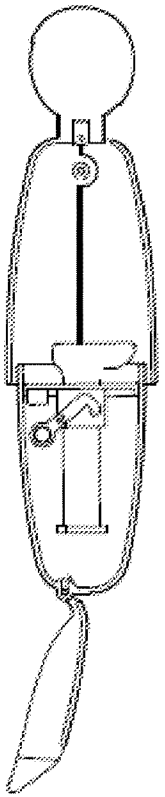
Figure 6J:
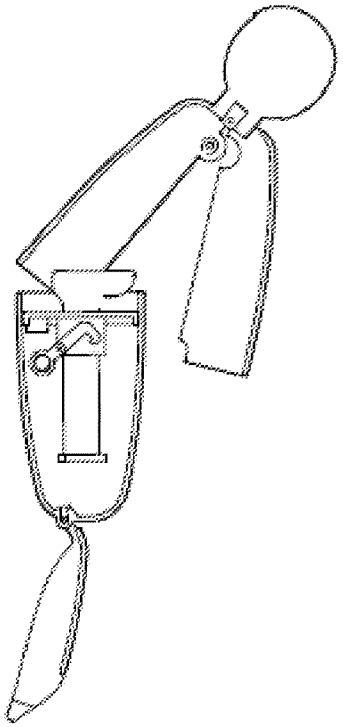
Figure 6H:
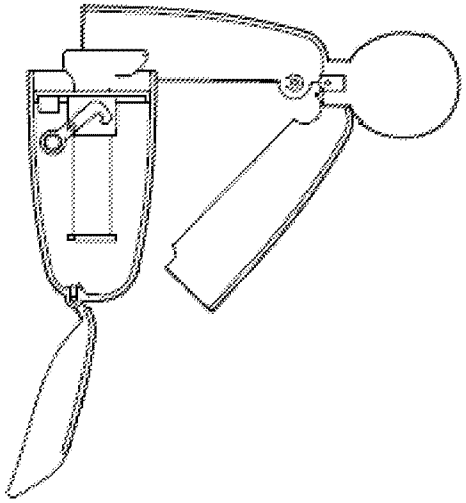
Figure 6G:
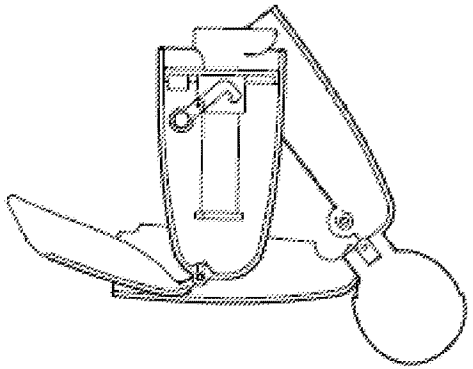

FIGS. 1A to 5B illustrate a toy 100, in accordance with an embodiment. FIG. 1A illustrates an exploded front view of the toy 100, and FIG. 1B illustrates an exploded rear view of the toy 100. FIG. 2 illustrates a side cross-sectional view of the toy 100 in a first configuration. FIG. 3 illustrates a front view of the toy 100 in the first configuration. FIG. 4A illustrates a side cross-sectional view of the toy 100 in the first configuration and FIG. 4B illustrates a front cross-sectional view of the toy 100 in the first configuration. FIG. 5A illustrates a front cross-sectional view of the toy 100 in a second configuration and FIG. 5B illustrates a front view of the toy 100 in the second configuration.

The toy 100 is transformable from the first configuration, illustrated in FIGS. 2 to 4B to a second configuration, illustrated in FIGS. 5A and 5B. The toy 100 includes a primary portion 200. The primary portion 200 defines a hollow cavity 206 therein. In a particular case, as illustrated in FIGS. 1A to 5B, the primary portion 200 includes a front section 202 and a rear section 204. The front section 202 and the rear section 204 can be pivotably connected to each other to abut and define the hollow cavity 206 therewithin. In this way, the front section 202 and the rear section 204 are complementary in shape and align as a single unit to form the primary portion 200. In a particular case, the front section 202 and the rear section 204 form halves of the primary portion 200. In some cases, the rear section 204 can be pivotably connected to the front section 202 via a suitable pivot mechanism 205. In other embodiments, the primary portion can include a front portion with an open back, such as with sides that curve rearwardly, to define the cavity for receiving the secondary portion 300. In such case, the tertiary portion can be located on a side of the secondary portion, the tertiary portion forming wings in the first configuration and forming a mermaid tail in the second configuration.

As will be described with respect to FIGS. 6A to 6K and FIGS. 7A to 7K, the front section 202 and the rear section 204 are configured to separate, at the ends opposite the pivot, when the toy is rotated in a frontward or rearward direction. For example, the front section 202 and the rear section 204 can separate at an angle of 75 degrees or more.

In some cases, other elements can be attached or connected to the primary portion 200, such as those that are representative of a person or character. For example, in the embodiment shown in FIGS. 1A to 5B, arms 208 are provided that extend away from the primary portion 200. In some cases, the arms 208 can be used to grasp, or provide leverage, to facilitate rotation of the toy. In the example shown in FIGS. 1A to 5B, a head 210 is also attached to the primary portion 200. The toy head may be shaped and sized as suitable. However, legs and head need not be used, and in some cases, other suitable elements can be used.

The toy 100 also includes a secondary portion 300 pivotably connected to the primary portion 200. In some cases, the secondary portion 300 can be pivotably connected to the primary portion 200 via a suitable pivot mechanism. Such mechanism can be situated at primary attachment points 212 on the primary portion 200 and secondary attachment points 310 on the secondary portion 300.

In some cases, as illustrated in the embodiment shown in FIGS. 1A and 1B, the secondary portion 300 includes a base 302 (shown in both FIGS. 1A and 1B), a front side 304 (shown best in FIG. 1A) and a rear side 306 (shown best in FIG. 1B), collectively defining a hollow interior 330. As shown, the front side 304 and the rear side 306 can be formed from a single piece; however, in other cases, the front side 304 and the rear side 306 can be formed from separate pieces. The secondary portion 300 is dimensioned to fit within the hollow cavity 206 defined within the primary portion 200.

As will be described with respect to FIGS. 6A to 6K and FIGS. 7A to 7K, the secondary portion 300 is configured to reside primarily inside the hollow cavity 206 (i.e., have a greater proportion of the secondary portion 300 inside the hollow cavity 206) in the first configuration upon rotation of the primary portion 200 (or toy in general) in a first direction. The secondary portion 300 is configured to primarily reside outside of the hollow cavity 206 (i.e., have a greater proportion of the secondary portion 300 outside of the hollow cavity 206) upon rotation of the primary portion 200 (or toy in general) in a second direction.

The base 302 is located at a bottom end of the secondary portion 300. In some cases, the base 302 can define one or more channels 312 therethrough. The channels 312 can permit sliding movement of one or more retractable elements 400 to substantially extend into the hollow interior 330 in the first configuration and extend substantially outside of the hollow interior 330 in the second configuration. In the example shown in FIGS. 1A to 5B, the one or more retractable elements 400 comprises a pair of legs; however, any suitable elements can be used. In the legs example, the feet can remain outside of the hollow interior 330 in the first configuration.

In some cases, the base can include a latch mechanism 308. The latch mechanism 308 can be pivotably connected to the base 302. The latch mechanism 308 can include a hook 320 on one end, a bias weight 324 located at an opposing end, and an attachment means 326 located between the ends. The latch mechanism 308 is pivotably attached to the base at the attachment means 326. When the toy 100 is in the first configuration, under the force of gravity, the bias weight 324 in forced towards the base and the hook 320 abuts the top of the one or more retractable elements 400; effectively stopping the retractable elements 400 from extending into the hollow interior 330. In some cases, a stopper 309 can be provided to stop further rotation of the latch mechanism 308. When the toy 100 is in the second configuration, under the force of gravity, the bias weight 324 in forced away from the base and the hook 320 is away from the one or more retractable elements 400; effectively allowing the retractable elements 400 to extend (and be stored) in the hollow interior 330. Advantageously, the latch mechanism 308 allows the toy to stand on a surface in the first configuration without having the legs retract into the secondary portion 300.

In some cases, a tertiary portion 500 can be attached to the secondary portion 300. The tertiary portion 500 can be pivotally connected to, or fixedly attached to, the secondary portion 300, as appropriate. The tertiary portion 500 is sized and dimensioned to reside in the hollow cavity 206 in the first configuration with the secondary portion 300. In the example shown in FIGS. 1A to 5B, the tertiary portion 500 is shaped as a mermaid tail that is pivotally connected near the top of the rear side 306 and formed to approximately match the shaping of the rear side 306; however, any suitable shape and connection point can be used. In further embodiments, the tertiary portion 500 can be the rear side 306; for example, having the mermaid tail pivotably connected to the front side 304.

FIGS. 6A to 6K show side cross-sectional views of the toy 100 illustrating rotation in a first direction from the first configuration to the second configuration. FIGS. 7A to 7K show side cross-sectional views of the toy 100 illustrating rotation in a second direction (opposite direction) from the second configuration to the first configuration. In these embodiments, the first direction is a forward direction, and the second direction is a rearward direction; however, the structure can be configured with the direction reversed or changed as suitable.

Starting from the first configuration, as can be seen in FIGS. 6A to 6F, the first 180 degrees of forward rotation result in the retractable elements 400 retracting inside the hollow interior 330. The retractable elements 400 are able to retract due to the latch mechanism 308 disengaging. As can be seen in FIGS. 6G to 6K, the next 180 degrees of forward rotation result in the rear section 204 separating from the front section 202 due to gravity acting upon it. As the rear section 204 separates, leaving a gap, the secondary portion 300 pivots out of the cavity 206, through the formed gap, due to gravity acting upon it. As the secondary portion 300 pivots out of the cavity 206, the tertiary portion 500 also pivots downwards, away from the secondary portion 300. In the second configuration, shown in FIG. 6K, the tertiary portion 500 (mermaid tail) is shown to the child and the retractable elements 400 (legs) are hidden, completing the transformation from human to mermaid.

Figure 7D:
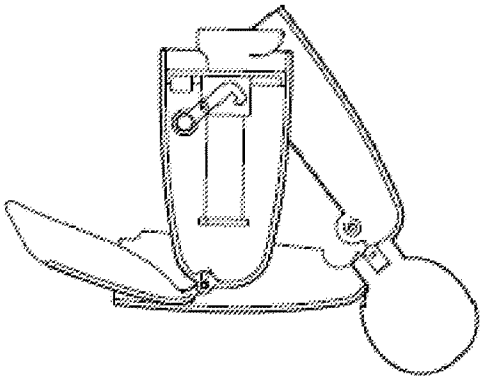
Figure 7C:
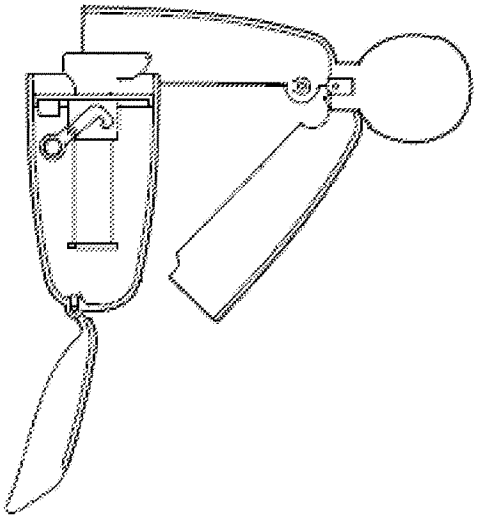
Figure 7B:
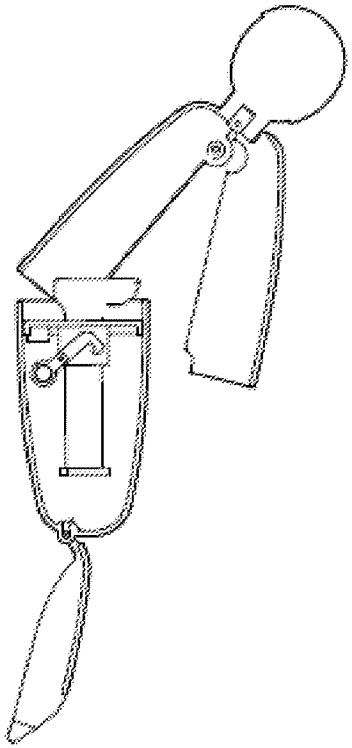
Figure 7A:
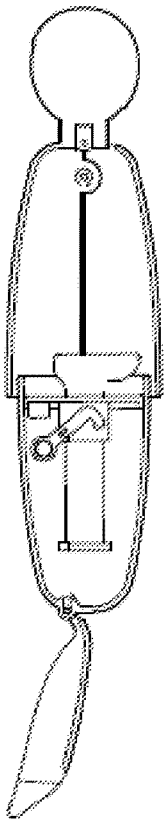
Figure 7G:
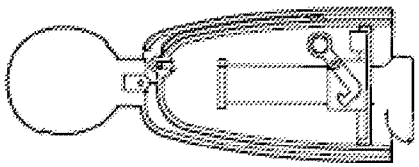
Figure 7K:
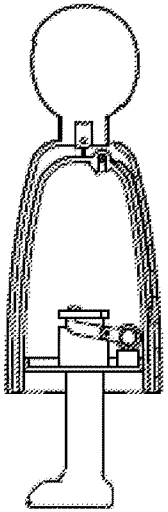
Figure 7F:
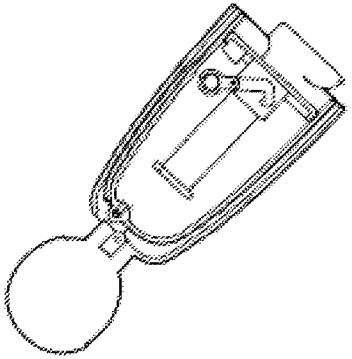
Figure 7J:
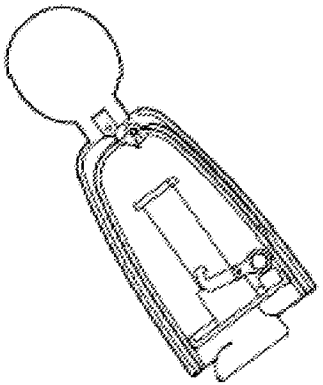
Figure 7E:
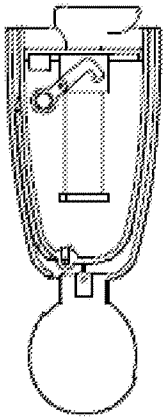
Figure 7H:
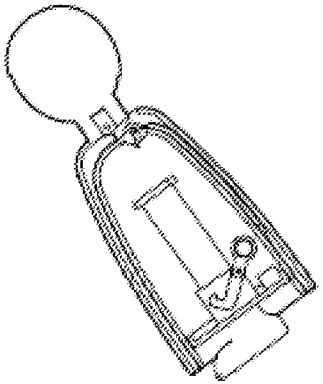

Starting from the second configuration, as can be seen in FIGS. 7A to 7D, the first 180 degrees of rearward rotation result in the rear section 204 separating from the front section 202 due to gravity acting upon it. As the rear section 204 separates, leaving a gap, the secondary portion 300 pivots into the cavity 206 due to being guided by the interior side of the rear section 204. Additionally, the tertiary portion 500 is also guided into the cavity 206 and against the back of the rear side 306. As can be seen in FIGS. 7E to 7K, the next 180 degrees of rearward rotation result in the retractable elements 400 sliding through the channels 312 and located substantially outside the hollow interior 330. The retractable elements 400 stop extending outwards when a larger diameter portion top portion of the retractable elements 400 abuts the top of the channels 312. As shown in FIG. 7K, when the retractable elements 400 are fully extended, the hook 320 of the latch mechanism 308 engages the top of the retractable elements 400 due to gravity acting on the bias weight 324.

Figure 8A:
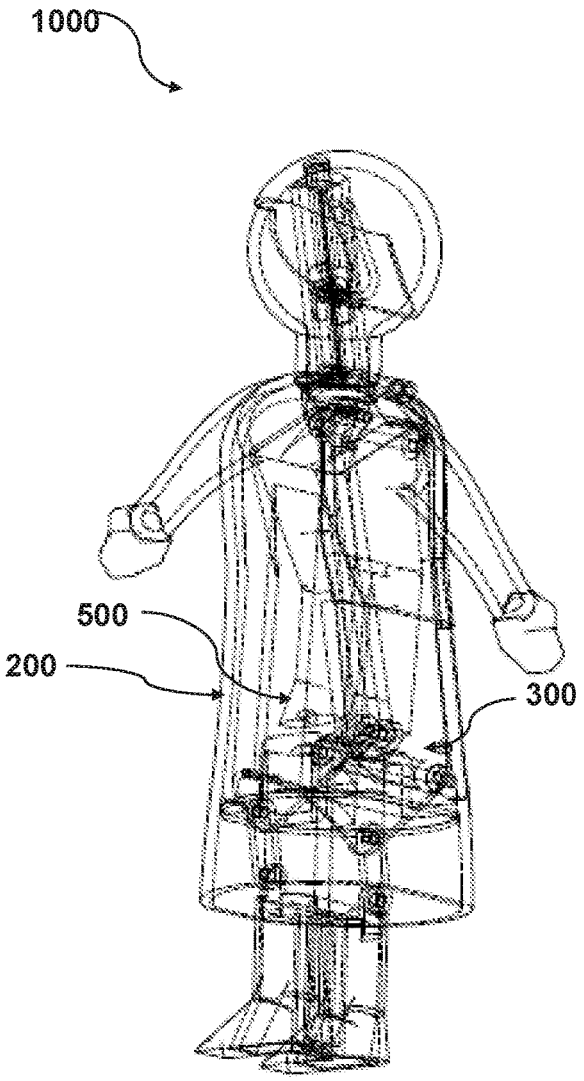
FIG. 8A is a front perspective cross-sectional view of a toy in a first configuration, in accordance with another embodiment.
Figure 8B:
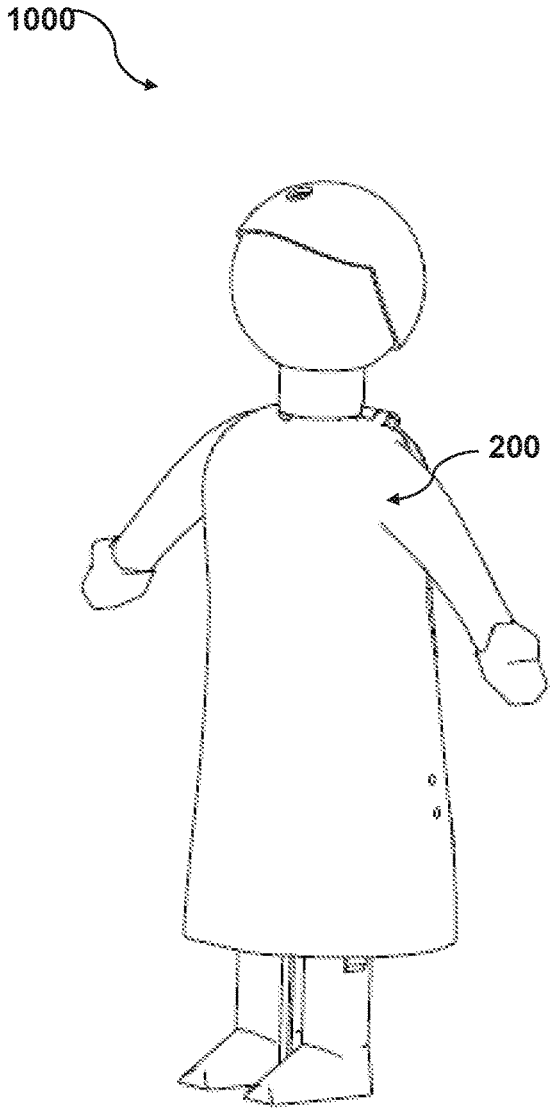
FIG. 8B is a front perspective view of the toy of FIG. 8A in the first configuration.
Figure 9A:
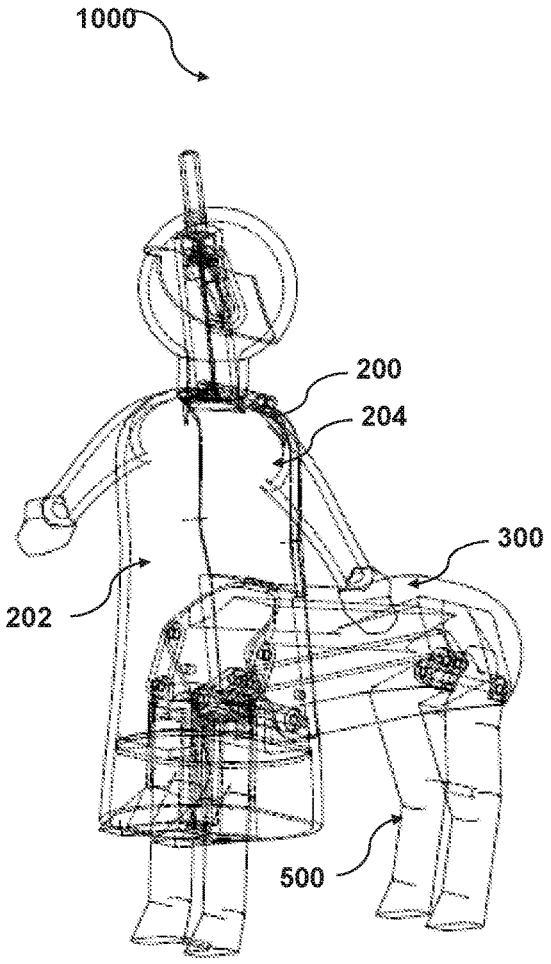
FIG. 9A is a front perspective cross-sectional view of the toy of FIG. 8A in a second configuration.
Figure 9B:
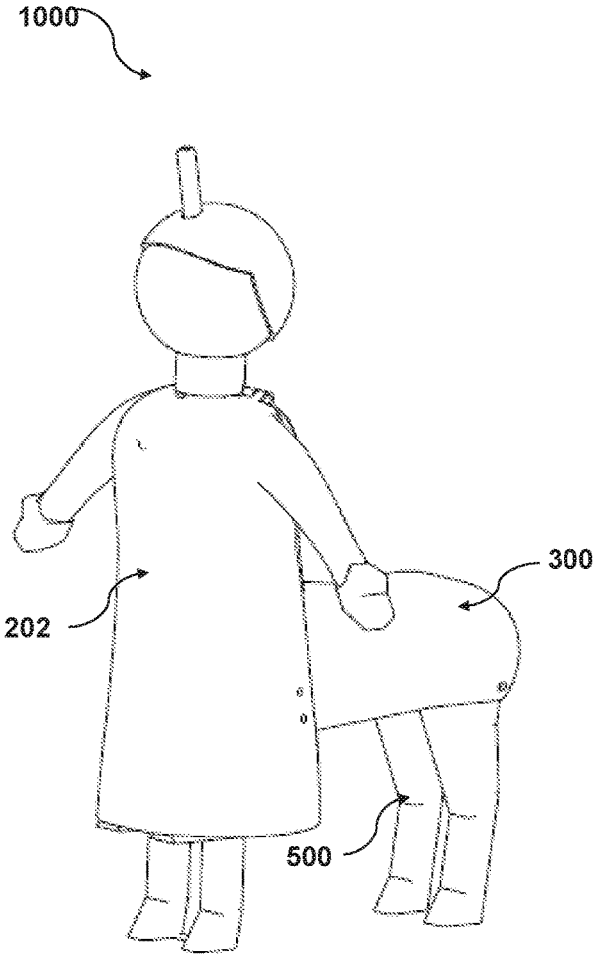
FIG. 9B is a front perspective view of the toy of FIG. 8A in the second configuration.
Figure 10A:
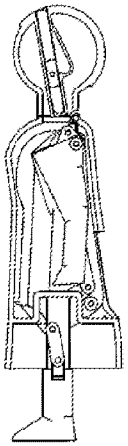
Figure 10B:
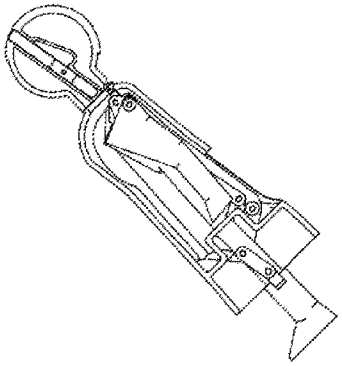
Figure 10C:
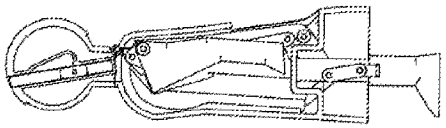
Figure 10D:
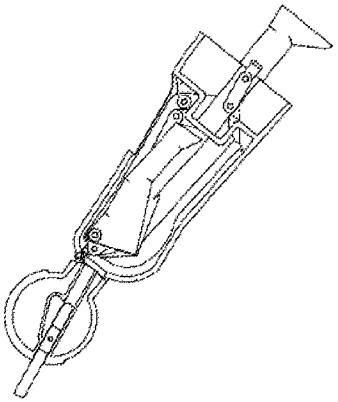
Figure 10E:
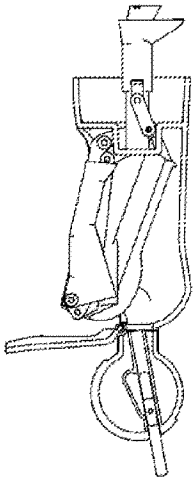
Figure 10J:
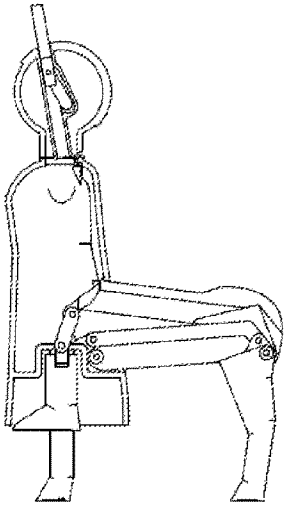
Figure 10H:
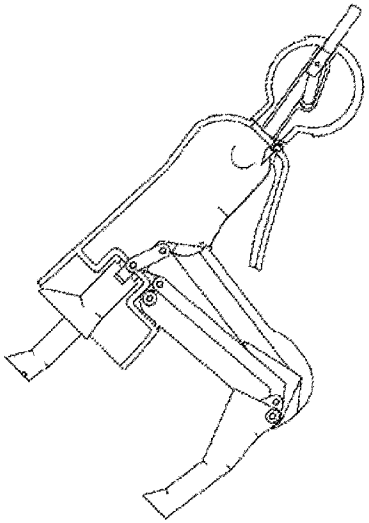
Figure 10G:
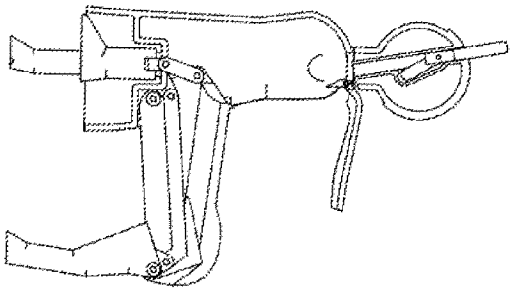
Figure 10F:
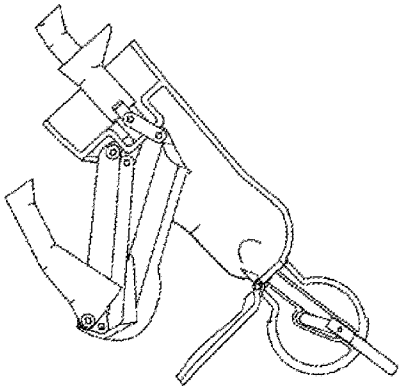
Figure 11D:
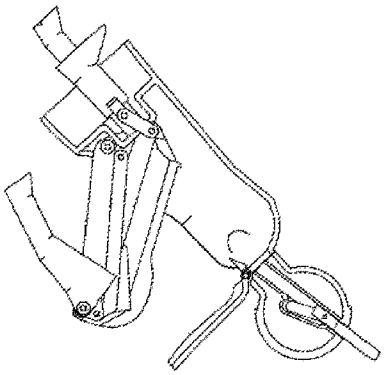
Figure 11C:
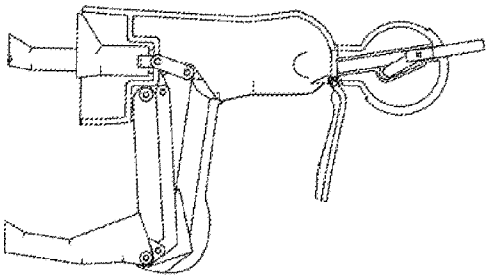
Figure 11B:
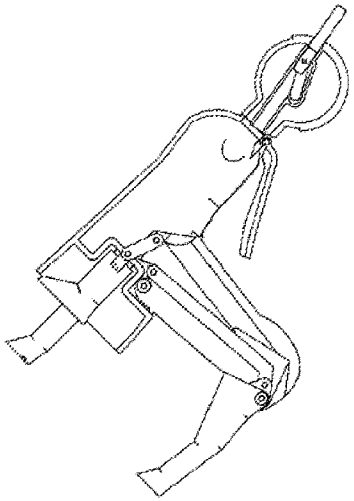
Figure 11A:
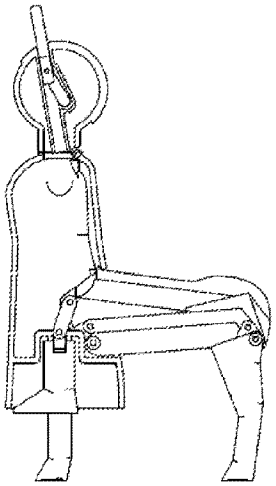
Figure 11G:
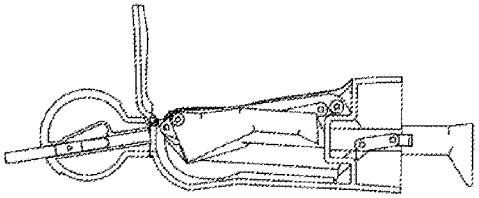
Figure 11F:
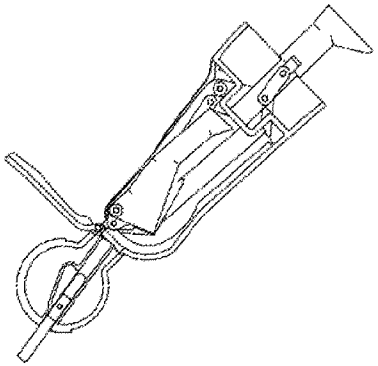
Figure 11E:
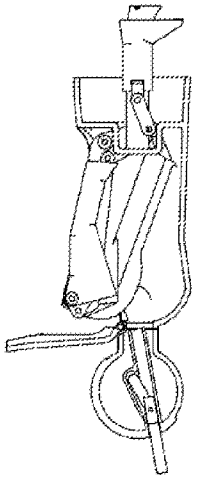
Figure 11J:
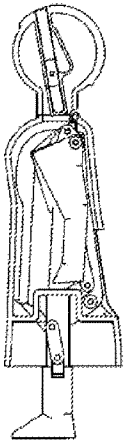
Figure 11H:
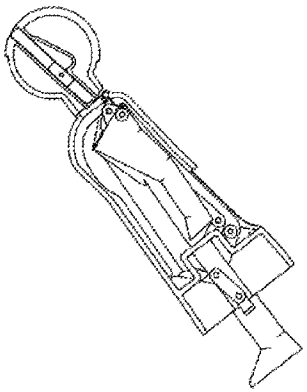

FIGS. 8A to 11J illustrate another embodiment of the transformable toy 1000. In this embodiment, the toy 1000 transforms from a first configuration in the form of a person, as shown in FIGS. 8A and 8B, to a second configuration in the form of a unicorn, as shown in FIGS. 9A and 9B.

Starting from the first configuration, as can be seen in FIGS. 10A to 10E, the first 180 degrees of forward rotation result in the rear section 204 separating from the front section 202 due to gravity acting upon it, leaving a gap. As can be seen in FIGS. 10F to 10J, the next 180 degrees of forward rotation result in the secondary portion 300 (horse body) pivoting out of the cavity 206, through the formed gap, due to gravity acting upon it. As the secondary portion 300 pivots out of the cavity 206, the tertiary portion 500 also pivots downwards, away from the secondary portion 300. In the second configuration, shown in FIG. 10J, the tertiary portion 500 (second set of legs) is shown to the child, completing the transformation from human to unicorn.

Starting from the second configuration, as can be seen in FIGS. 11A to 11D, the first 180 degrees of rearward rotation result in the rear section 204 separating from the front section 202 due to gravity acting upon it. As the rear section 204 separates, leaving a gap, the secondary portion 300 pivots into the cavity 206. Additionally, the tertiary portion 500 is also pivoted into the cavity 206. As can be seen in FIGS. 11E to 11J, the next 180 degrees of rearward rotation result in the rear section 204 coming back to abut the front section 202, and thus, close the cavity 206.

Advantageously, the toy of the present embodiments provides easy transformation from a first configuration to a second configuration. The toy of the present embodiments affords selective transformation without cumbersome transformation mechanics.

While the present embodiments generally describe toy with transformation from a human with legs to a mermaid; it is understood that the present embodiments can likewise be applied to any suitable toy transformation, for example, from a unicorn into a fairy with wings, from a caterpillar into a butterfly, or the like.

While the exemplary embodiments are described and illustrated herein, it will be appreciated that they are merely illustrative. It will be understood by those skilled in the art that various modifications in form and detail may be made therein without departing from the scope of the invention except as it may be described by the claims appended hereto.

The invention claimed is:

1. A toy transformable between a first configuration and a second configuration, the toy comprising:

an open or openable primary portion defining a hollow cavity;

a secondary portion pivotably connected to the primary portion at one or more attachment points, the attachment points located in proximity to a bottom of the primary portion, the secondary portion primarily resides inside the hollow cavity in the first configuration, wherein a full rotation of the primary portion in a first direction causes the secondary portion to pivot around the attachment points and out of the hollow cavity due to the gravitational force acting on the secondary portion and causes the secondary portion to primarily reside outside of the hollow cavity, the toy is in the second configuration when the secondary portion primarily resides outside of the hollow cavity, and wherein a full rotation of the primary portion in a second direction, opposite to the first direction, causes the secondary portion to pivot around the attachment points and into the hollow cavity due to the gravitational force acting on the secondary portion and causes the secondary portion to primarily reside inside of the hollow cavity in the first configuration.

2. The toy of claim 1, wherein the primary portion comprises a front section and a rear section, the front and the rear section are pivotably connected to abut in the first configuration and in the second configuration, and to define the hollow cavity therebetween.

3. The toy of claim 2, wherein the rear section separates from the front section by pivoting outwardly when the toy is in transition between the first configuration and the second configuration.

4. The toy of claim 2, wherein the front section and the rear section are configured to vertically align when in the first configuration and in the second configuration.

5. The toy of claim 1, wherein the secondary portion comprises a base and sides collectively defining a hollow interior, the base defining channels for one or more retractable elements to pass therethrough, the one or more retractable elements substantially extend into the hollow cavity in the first configuration and extend substantially outside of the hollow cavity in the second configuration.

6. The toy of claim 5, wherein a pivotable latch is disposed inside the hollow cavity to engage the one or more retractable elements and restrict upward movement of the one or more retractable elements into the hollow interior in the second configuration, and rotate to disengage from the one or more retractable elements in the first configuration.

7. The toy of claim 6, wherein the one or more retractable elements comprise legs.

8. The toy of claim 1, further comprising a tertiary portion pivotably connected to the secondary portion, the tertiary portion is dimensioned to reside inside the hollow cavity with the secondary portion in the first configuration, the tertiary portion pivots away from the primary portion in the second configuration upon rotation in the second direction.

9. The toy of claim 8, wherein the tertiary portion is a mermaid tail or wings.

10. The toy of claim 8, wherein the secondary portion comprises a horse body and the tertiary portion comprises a secondary set of legs.

11. The toy of claim 1, wherein the primary portion comprises a front section that curves towards a rear to define the hollow cavity.

12. The toy of claim 11, further comprising a tertiary portion located on a side of the secondary portion, the tertiary portion forming wings in the first configuration and forming a mermaid tail in the second configuration.

* * * * *